US010881222B1

(12) United States Patent
Keane London et al.

(10) Patent No.: US 10,881,222 B1
(45) Date of Patent: Jan. 5, 2021

(54) APPARATUS TO FACILITATE PHYSICAL DISTANCING

(71) Applicant: Stephanie Van Keane London, Boise, ID (US)

(72) Inventors: Stephanie Van Keane London, Boise, ID (US); John Michael London, Boise, ID (US); Willet Christopher Howard, Star, ID (US); David Michael Kelley, Boise, ID (US); Christopher John Pearen, Brampton (CA)

(73) Assignee: Stephanie Van Keane London, Boise, ID (US)

( * ) Notice: Subject to any disclaimer, the term of this patent is extended or adjusted under 35 U.S.C. 154(b) by 0 days.

(21) Appl. No.: 16/880,485

(22) Filed: May 21, 2020

(51) Int. Cl.
*A47F 10/06* (2006.01)

(52) U.S. Cl.
CPC ..... *A47F 10/06* (2013.01); *A47F 2010/065* (2013.01)

(58) Field of Classification Search
CPC .... A47F 10/06; A47F 2010/065; A47B 57/00; A47B 46/00; A47B 46/005; A47B 96/04
USPC ..... 312/140.4; 108/97, 98
See application file for complete search history.

(56) References Cited

U.S. PATENT DOCUMENTS 1,737,081 A * 11/1929 Foucher ..... D06F 81/003 248/117.4
1,878,864 A * 9/1932 Lane ..... A47D 3/00 312/140.4
2,710,051 A * 6/1955 Greenberg ..... A47C 7/70 108/6
2,781,992 A * 2/1957 Cunningham ..... A24F 19/0092 131/241
3,106,376 A * 10/1963 Scott ..... A47B 27/00 248/447.2
5,351,897 A * 10/1994 Martin ..... A47B 21/0314 248/118
6,293,414 B1 * 9/2001 Stuart ..... A47B 55/02 108/108
8,985,033 B1 * 3/2015 Whitlock ..... A61M 37/0076 108/152
9,089,203 B1 * 7/2015 Al-Raqadi ..... A47B 17/033

* cited by examiner

*Primary Examiner* — Andrew M Roersma
(74) *Attorney, Agent, or Firm* — Thomas Coester Intellectual Property

(57) ABSTRACT

Embodiments of the invention include a barrier assembly including a frame to hold a barrier member. A bracket defines a track and the bracket can be attached to a support surface such that a first branch of the bracket resides on a first side of the support surface and a second branch of the bracket resides on a second side of the support surface. An articulating connector couples the frame to track, the articulating connector enables the frame to move in at least two degrees of freedom relative to the track. The frame and connector can move along the track from a first position in which the frame resides above the support surface to a second position in which the frame resides below the support surface.

16 Claims, 13 Drawing Sheets

APPARATUS TO FACILITATE PHYSICAL DISTANCING

BACKGROUND

Technological Field

Embodiments of the invention relate to partitions to enable physical distancing. More specifically, the embodiments of the invention relate partitions to provide a removable barrier to enable physical distancing along public counter spaces and tables.

Background

The novel corona virus that causes COVID-19 has been highly disruptive to the global economy. Even as the economy reopens, strict physical distancing is likely to be required to avoid recurrence of mass infections. Existing guidelines recommend at least six feet between unrelated parties.

While many businesses are erecting fixed barriers to separate patrons, or separate patrons from staff, such fixed barriers are not practical in many circumstances. Additionally, some businesses are restricting the number of patrons permitted in the establishment to allow greater space between customers. This is also not practical for some businesses. One area that has been particularly hard hit is food services particularly bars and restaurants. While individual tables in a restaurant can be segregated with fixed or free-standing barriers, bars and communal tables cannot reasonably be segregated in this manner.

A typical bar provides 2-3 feet of space per patron. This is well below the existing health guideline. Removing e.g. half the stools is not likely to be effective as many patrons stand at the bar. And if the number of patrons is reduced to meet the guidelines, the economic viability of the bar may become in doubt. Additionally, having fixed stations along the bar separated by barriers will make the bar unattractive to groups who go to the bar to socialize together.

The problem is equally acute in the gaming industry that requires a critical mass of patrons to be profitable or in some cases such as poker to even play the game. As with bars, gaming is a social activity and groups often go to the casino to enjoy each other's company in the context of the entertainment that gaming provides.

BRIEF DESCRIPTION OF THE DRAWINGS

Embodiments of the invention are illustrated by way of example and not by way of limitation in the figures of the accompanying drawings in which like references indicate similar elements. It should be noted that different references to "an" or "one" embodiment in this disclosure are not necessarily to the same embodiment, and such references mean at least one.

DETAILED DESCRIPTION

Embodiments of the invention provide solutions to enable reopening of bars, restaurants, gaming establishments and the like in view of the physical distancing required by COVID-19. Generally, for bars and gaming tables, patrons want to sit with their group, but the establishment needs to enable separation from other patrons to reduce the risk of the disease. Embodiments of the invention provide a protective barrier that can be easily moved from a deployed position to a stowed position on a bar, gaming table or other community surface.

Figure 1:
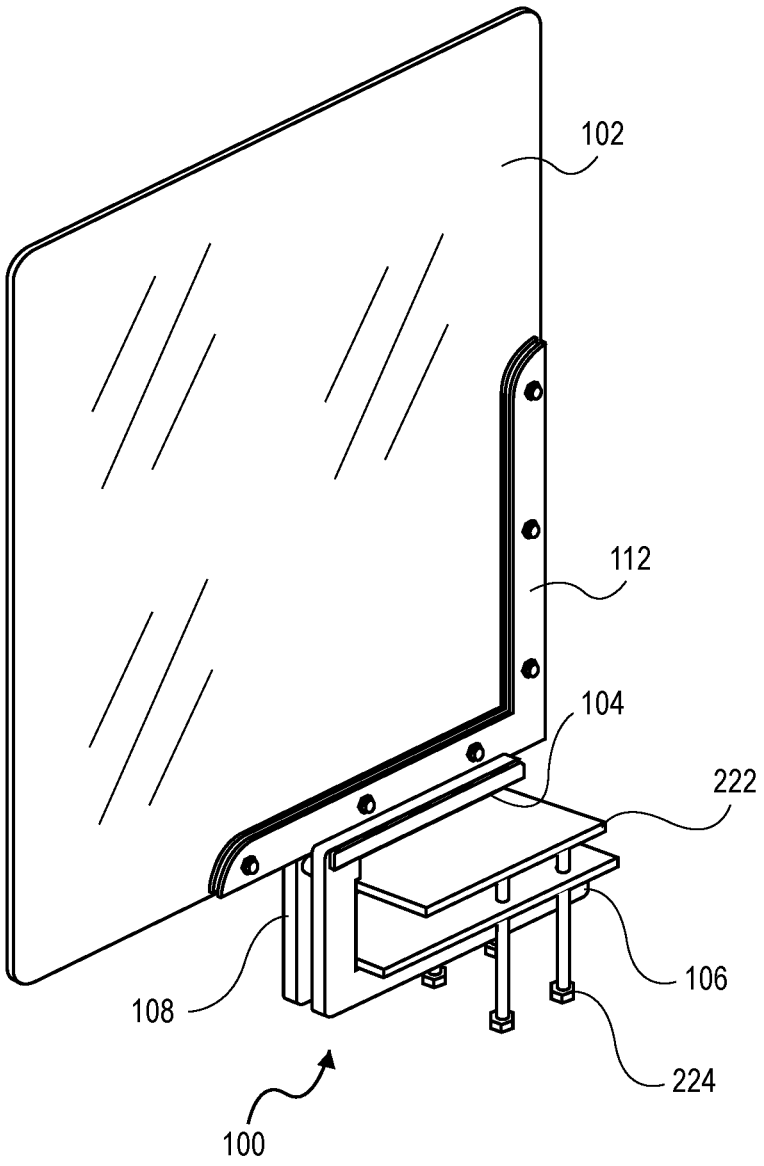
FIG. 1 is an elevated perspective view of an embodiment of the invention in a deployed configuration.

FIG. 1 is an elevated perspective view of an embodiment of the invention in a deployed configuration. In one embodiment, a barrier 102 can be deployed to reside above a communal surface such as a bar, gaming table or communal table at a restaurant or cafeteria to provide separation between patrons. A bracket 100 has a first branch 104 that, in use, resides above the supporting surface and a second branch 106 that resides below the supporting surface. The two branches are coupled together through intermediate segment 108. In use intermediate segment 108 resides forward of the supporting surface and provides a track to allow the barrier 102 to be moved to a stowed configuration as described in more detail below.

Barrier 102 resided in a frame 112 that engages and locks to first branch 104 of bracket 100. When locked in place, the barrier 102 remains substantially parallel to the first branch 104 and substantially perpendicular to the communal surface to which it is attached. Second branch 106 defines a plurality of bores to enable coupling of the bracket 100 to the communal surface. In one embodiment, a plurality of bolts 224 pass through bores and engage a clamp plate 222. By tightening bolts 224, the bracket 100 clamps the communal surface between the clamp plate 222 and the first branch. In other embodiments, the clamp plate 222 may be omitted and connectors such as screws, nails, adhesives or the like can couple the second branch 106 directly or through an additional shim or other substrate to the underside of the supporting surface.

Installing a plurality of the devices along for example a bar, provides individual patrons with separation from adjacent patrons whether standing or sitting at the bar. Moreover, because the barrier 102 can be easily transitioned to a stowed position (as described below), groups can sit or stand together without the inconvenience of separation barriers.

Figure 2:
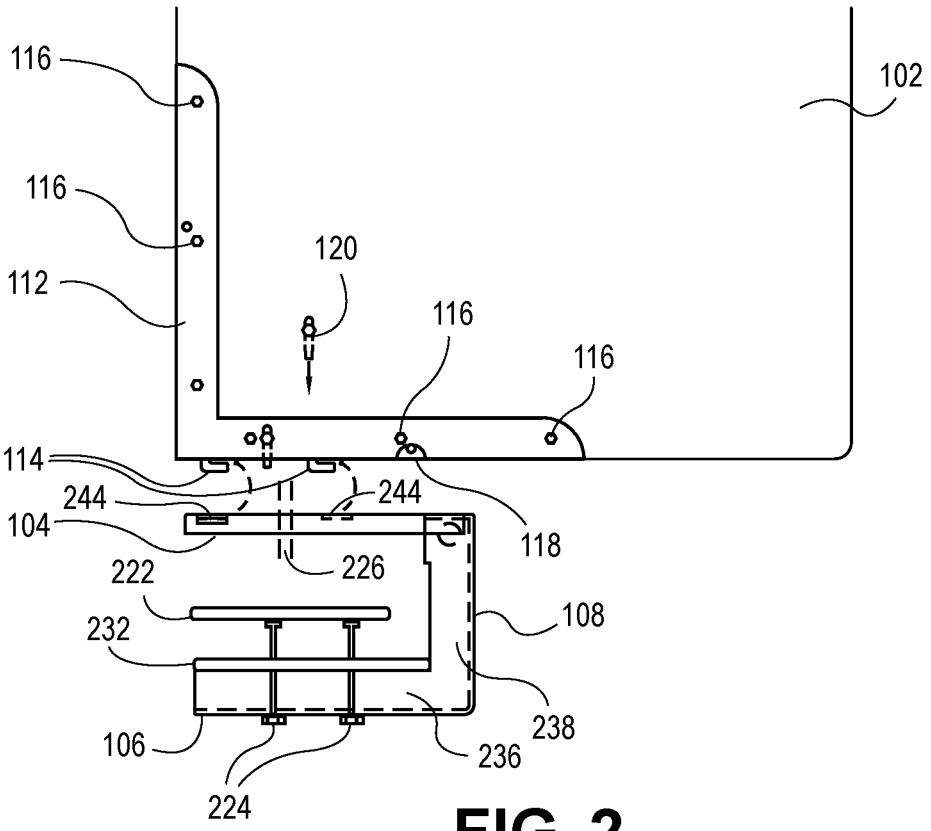
FIG. 2 is a partial exploded view of one embodiment of the invention.

FIG. 2 is a partial exploded view of one embodiment of the invention. As explained above, the bracket 100 is formed to have two branches, first branch 104 reside above a supporting surface in use and second branch 106 resides below the supporting surface. First branch 104 and second branch 106 are coupled together through intermediate segment 108. This results in a generally U-shaped bracket. As used herein any bracket with a first and second branch coupled together by an intermediate segment is deemed U-shaped independent of the relative lengths of the brackets. While in the shown embodiment, the intermediate segment 108 is straight, in other embodiments, the intermediate member may be arcuate, for example, to better accommodate supporting surfaces with a rounded leading edge.

In some embodiments, the first and second branches 104, 106 are each welded or assembled to the intermediate segment 108 to form the bracket. In one embodiment, second branch 106 is a flanged channel. The flange 232 defines the bores through which connecting bolts 224 pass to engage clamping plate 226. Tightening bolts 224 causes clamping plate to rise to engage the underside of the communal surface and clamp the surface between the clamping plate 222 and the first branch 104. Items 104,106 and 108 could also be assembled, fabricated or manufactured with alternate materials or processes The second branch 106 defines a channel 236 that defines an internal track. Channel 236 that communicates with a channel 238 defined by the intermediate segment 108. Channel 238 also defines an internal track that in conjunction with the track defined within channel 236 provides a path along which a barrier assembly can move. That is, as discussed in more detail below, the barrier 102 is coupled to the bracket 100 by an connector that resides in the channel 238 when the barrier is deployed and transitions (with the barrier) along the track to reside in channel 236 when the barrier is stowed.

While in some embodiments, both the first branch 104 and the second branch 106 may be the same length, in other embodiments the second branch is longer and may be "cut to fit" to accommodate different communal surfaces. In one embodiment, both the first and second branches 104, 106 are in the range of 6-8". In other embodiments, first branch 104 is in the range of 6-8" and second branch 106 is up to 18" and can be shortened as desired. These dimensions are only examples and other length of the first branch 104 or second branch 106 could be used in other embodiments.

As shown, the barrier 102 is provided coupled within a frame 112. The frame 112 could be formed of for example two independent pieces of L shaped steel. For example, in one embodiment, each side of frame 112 may be stamped from ⅛" steel with a cross dimension of 1.25 inches. These dimensions have been found to have sufficient structural stability for most uses but are not believed to be essential to embodiments of the invention. Other embodiments may be formed from different materials and/or with different dimensions.

Attachment features 114 may be formed in the course of the stamping. Attachment features 114 are formed to engage branch 104 in for example receiving slots 244 to provide a stable retention of the frame 112 on the first branch 104. Attachment features 114 may be hook tabs or substantially any other shape that can provide a stable attachment to the first branch 104. The receivers for the attachment features 114 are defined to accommodate the shape of those features 114.

In other embodiments, the frame is formed with a closed end L, that is the edge of barrier 102 is not expose within the frame to the left or bottom of FIG. 2. In such embodiments a channel is formed in the L to receive the barrier 102. In some embodiments, a frame may be formed from extruded aluminum. In other embodiments, the frame may be formed from synthetic material such as glass impregnated polymers. Other suitable materials will occur to those of ordinary skill in the art. In some embodiments, the frame and attachment features could be integrally formed with the barrier. For example, the entire assembly could be molded from a single synthetic material or could be double molded such that different materials are used for different parts of the assembly. In still another embodiment, the assembly could be inset molded to allow the introduction of desired metal components with the remaining molded synthetic components.

The barrier 102 could be formed from acrylic also known as plexiglass, tempered glass, polycarbonate or the like. In different embodiment, the barrier 102 may be colored or colorless. In different embodiments, the barrier 102 may be transparent, translucent or opaque. In one embodiment, ⅛" acrylic is used for the barrier 102. Acrylic has favorable weight, cost and workability characteristics. Other embodiments may use acrylic of different thicknesses. Exposed corners of the barrier can be filleted so that no sharp corners are exposed. Some commercially available acrylics have antimicrobial properties. For example, Lucite Microban® is available from Emco Industrial Plastics Inc. of Cedar Grove new Jersey. Such antimicrobial plastics may provide additional benefits in the context of physical distancing and cleaning.

Barrier 102 may define a cutout 118 to accommodate an connector as described in greater detail below. Barrier 102 also defines a slot for locking pin 120. In one embodiment, locking pin 120 may be spring biased to an engaged position. In another embodiment, locking pin 120 may rely on gravity to hold it in an engaged position. In still another embodiment, locking pin 120 has a threaded actuator knob that can be tightened to hold the locking pin 120 in either the engaged or disengaged position.

For embodiments where the frame is formed of two pieces, the barrier 102 may be sandwiched between the two pieces of the frame 112 with the locking pin 120 residing in the defined slot. Bolts, rivets, or other suitable connectors via connection bores 116 retain the sandwiched assembly as a unit. In other embodiments, the barrier 102 may be slid into the channel of the L shaped frame (with the locking pin 120 in place) and then bolted or riveted together. For aesthetic reasons, in such embodiments it is desirable that the barrier be shaped to accommodate the thickness of the frame material such that the barrier extends substantially flush from the distal edges of the L shaped frame. Other embodiments may use adhesives to couple the frame 112 to the barrier 102, in such embodiments, bores 116 would be unnecessary.

In some embodiments, the frame 112 and the bracket 100 may be provided with substantially any desired surface finish. In different embodiments, the component may be powdered coated, anodized, electroplated or surface treated in any other manner that retains the structural integrity of the components. In some embodiments, the components are cast, extruded, molded or otherwise formed from materials such as stainless steel, brass, copper or fiber infused plastics that naturally have a desired surface finish.

Figure 3:
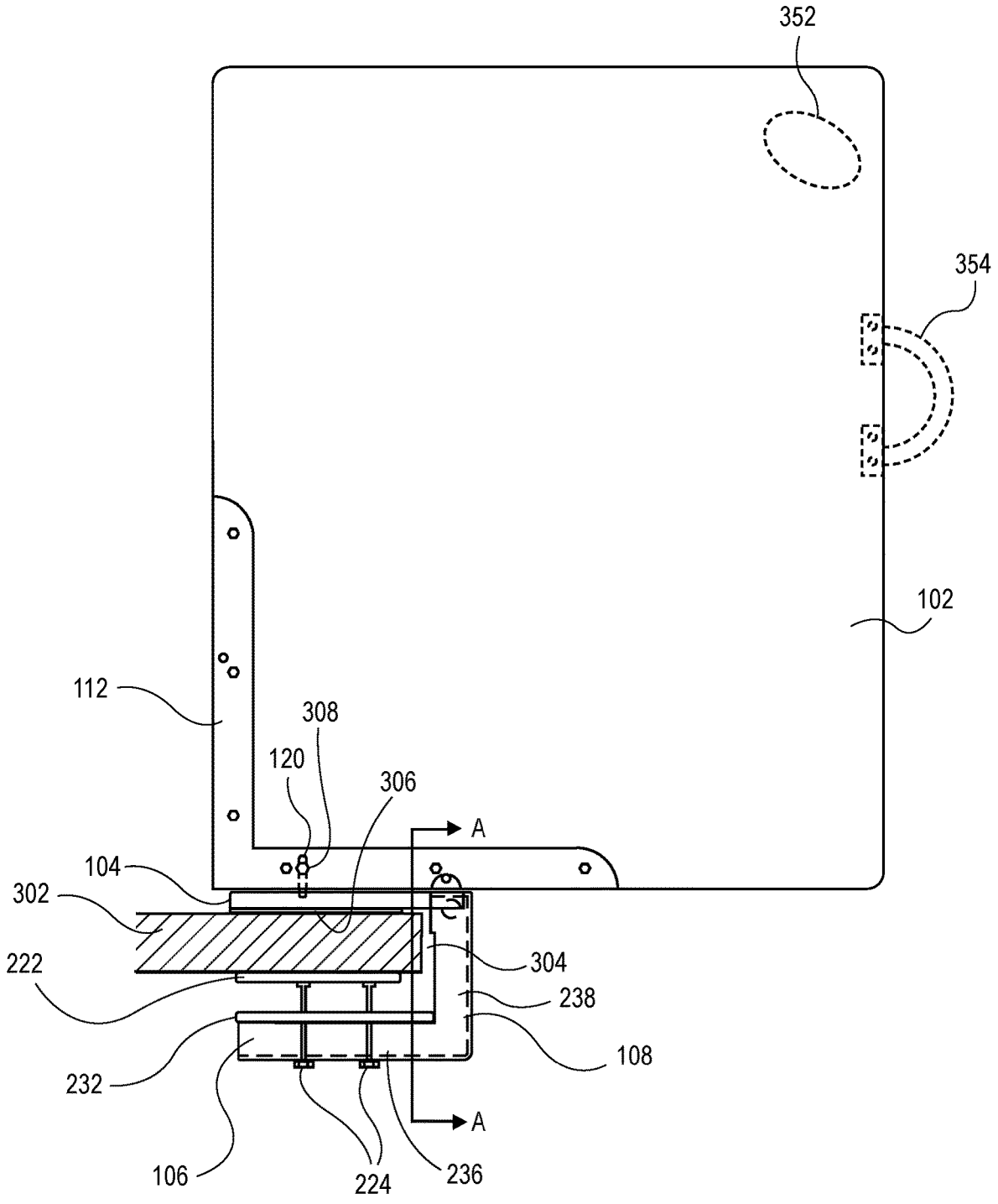
FIG. 3 is a view of an embodiment of the invention installed on a surface.

FIG. 3 is a view of an embodiment of the invention installed on a surface. In this view, the supporting surface 302 is shown in sectional view. The length of intermediate segment 108 and the range of the bolts 224 provide for the clamping plate 222 defines the range of thickness of surface 302 that can be accommodated by the embodiment. Bolts of different lengths can be selected for particular applications. Tightening bolts 224 clamps the surface 302 between clamping plate 222 and the first branch 104. In some embodiments, one or more spacers 306 may be provided to protect the upper side of supporting surface 302 from wear and damage from interaction with the bracket 100. In one embodiment the spacer may be made polyurethane. In other embodiments, felt or other nonreactive elastomeric materials could be used for spacer 306. In some embodiments, clamping plate 222 may also include a protective coating or cover to reduce the risk of damage to the underside of surface 302. Similarly, protective materials may be introduced into any space 304 between intermediate segment 108 and the leading edge of surface 302.

While it is not necessary to provide a handle for use with the invention, in this view two possible handle options are shown in phantom lines. In one embodiment, a handle 352 could be formed integrally as a cutout of barrier 102. In another embodiment, a separate handle 354 could be attached anywhere along an exposed edge of barrier 102. In some cases, the handle 252, 254 may aid a user in transitioning the barrier from the deployed configuration to a stowed configuration.

Locking pin 120 resides within the frame 112 and engages a locking bore in the first branch 104. When engaged, the frame 112 cannot move forward or backward along the branch and the attachment features (114 in FIG. 2) cannot dislodge from their receivers. An actuator knob 308 permits a user to move the locking pin 120 between the engaged and disengaged positions. As previously noted, locking pin 120 may be spring biased to an engaged position. In another embodiment, locking pin 120 may rely on gravity to hold it in an engaged position. In still another embodiment, actuator knob 308 may be threaded so that it can be tightened to hold the locking pin 120 in either the engaged or disengaged position.

Figure 4:
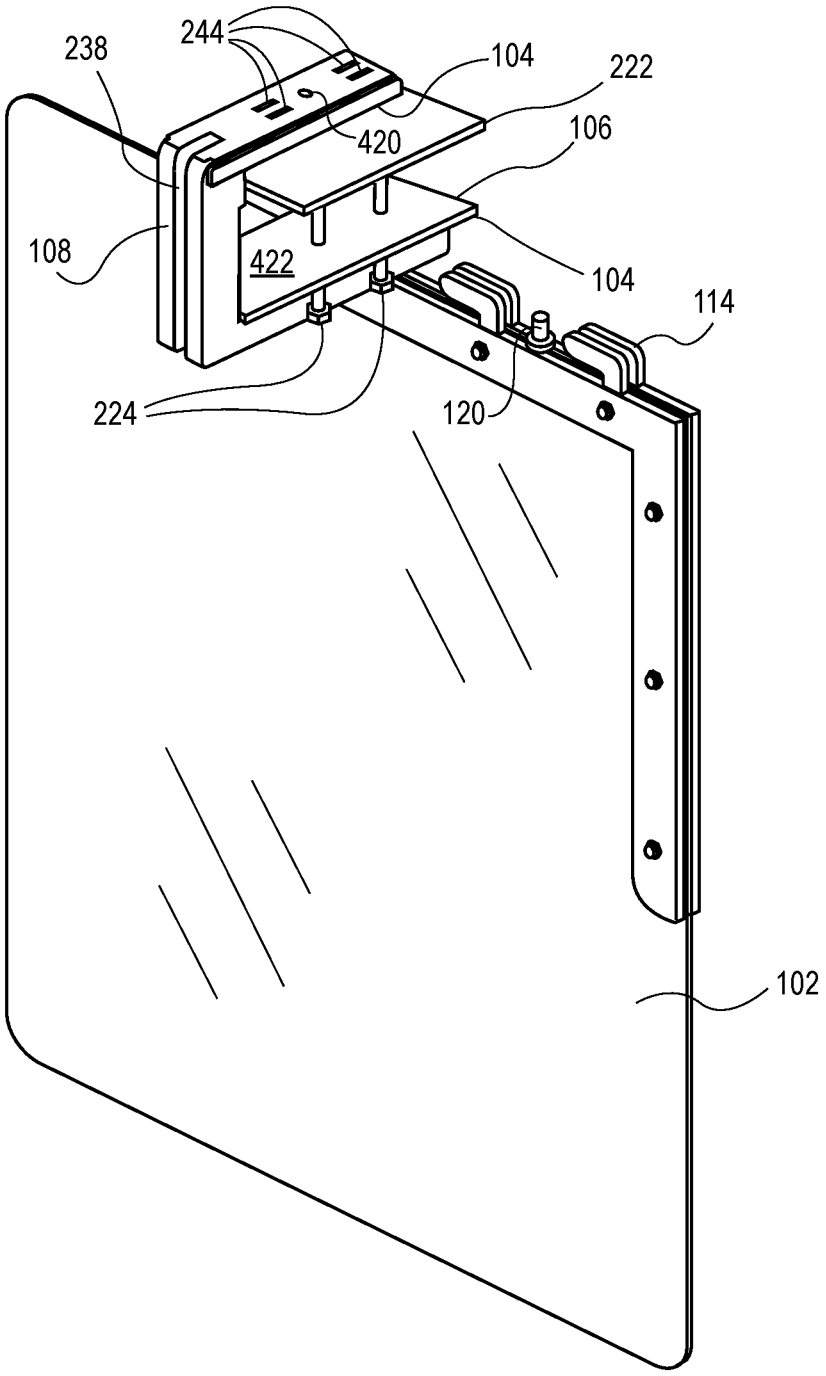
FIG. 4 is a perspective view of an embodiment of the invention in a stowed configuration.

FIG. 4 is a perspective view of an embodiment of the invention in a stowed configuration. In the stowed configuration, the attachment features 114 have been disengaged from the receivers 244 in first branch 104. To disengage the attachment features 114 locking pin 120 is first disengaged from locking bore 420. The barrier 102 then transitions along the track within channel 238 in the intermediate segment 108 the track continues within channel 236 (not shown in this view) in the second branch 106. The connector (described in detail below) permits the barrier to move along the track in channels 238,236 and rotate relative to the channels. The allows the barrier 102 to reside, for example. substantially perpendicular to second branch 106 in the stowed orientation. In this way when stowed, the barrier 102 can remain adjacent to e.g. the vertical portion of the bar where it is less intrusive to patrons. In some embodiments, the barrier 102 merely hang under the influence of gravity near the distal end of the second branch 106. Other embodiments may include a feature to bias the barrier 102 to remain at the distal end of the second branch. Some of those options are discussed in greater detail below.

In some embodiment, clamping surface 422 of clamp plate 122 may be coated or have, for example, an elastomeric layer thereon to either increase grip on the surface when connected, reduce the risk of surface damage to the surface or both.

Figure 5B:
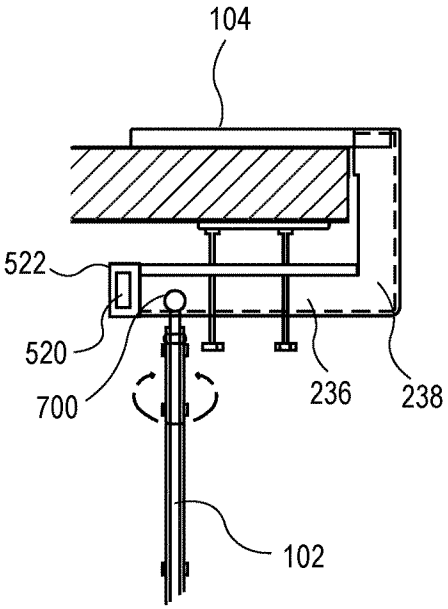
FIGS. 5A and B are views of one embodiment of the invent showing a path of travel to the stowed configuration.
Figure 5A:
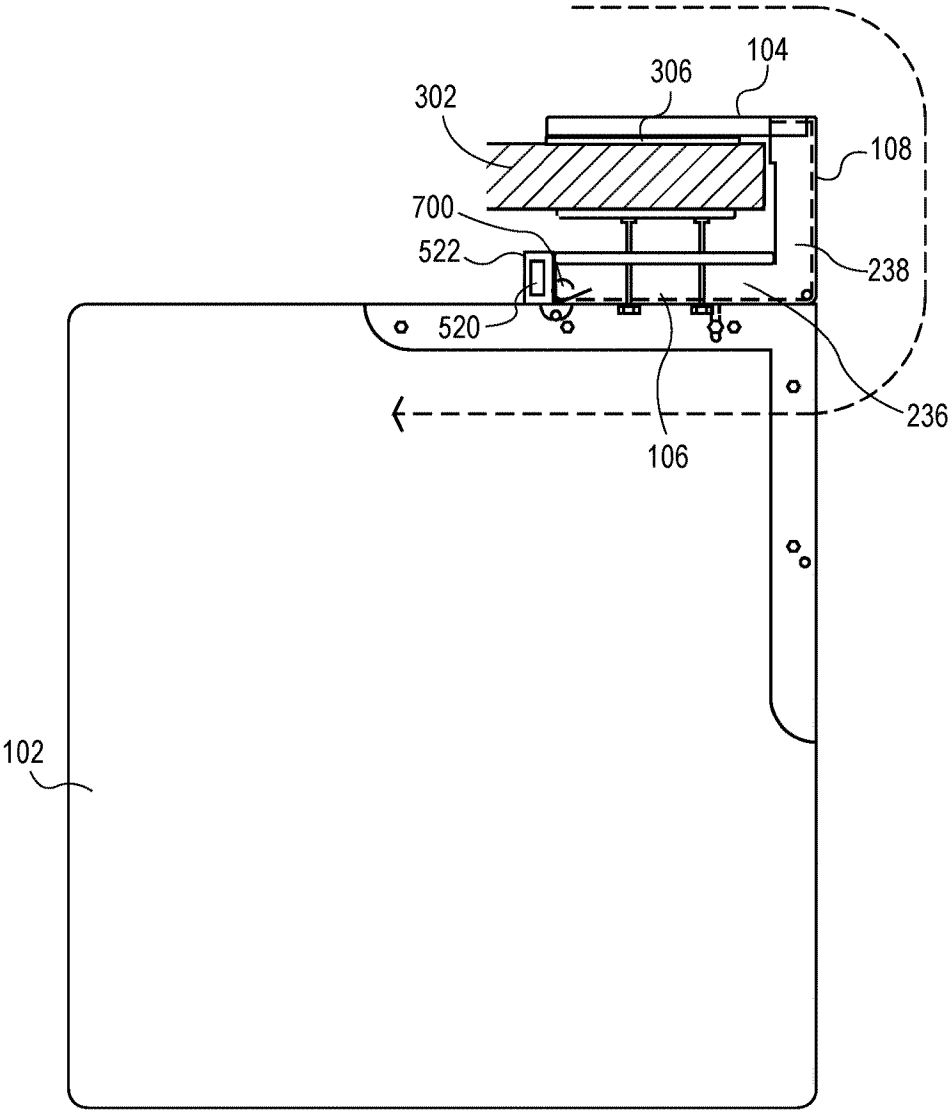

FIGS. 5A and B are views of one embodiment of the invention showing a path of travel to the stowed configuration. As shown in FIG. 5A, the barrier can transition in a path from the first branch to the second branch as connector 700 moves down the track in channel 238 and then along the track in channel 236. The connector 700 permits the rotation of the barrier 102 as shown in FIG. 5B. One exemplary embodiment of the connector is described in detail with reference to FIGS. 8A-8C below.

In some embodiments, the distal end of the second branch may be sealed with a cap 522. Cap 522 can be formed of plastic, rubber or any other suitable material. The primary purpose of cap 522 is to provide a stop that prevents the connector from leaving the distal end of the channel 236. In some embodiments, cap may also have for example a rare earth magnet such as a neodymium magnet embedded therein to apply a magnetic force to the connector to hold the barrier 102 near the distal end of second branch 106 unless a user applies a force to overcome the magnet. In other embodiments, instead of a cap, the magnet 520 or multiple magnets could be affixes within the channel (either bottom or sides again to act on the connector 700 to hold it in a desired location. In such an embodiment the distal end could remain open and the magnets used to ensure the connector does not escape the channel 236 unless a force is applied by the user. Any of these options provide for easy serviceability in the even a barrier is damaged and needs to be repaired or replaced.

While magnets are convenient, other ways to bias the connector to remain near the distal end of the channel 236 are also contemplated. For example, one or more detents could be provided near the distal end. In some embodiments, the channel 236 may be installed with a slight downward slope such that gravity will bias the connector 700 to remain at the distal end. In other embodiments a slight recess, cup, or depression may be defined in the channel 236 proximate to the distal end. Other ways in which the connector 700 and therefore the barrier 102 may be biased to remain in a desired location will occur to those of skill in the art.

Figure 6A:
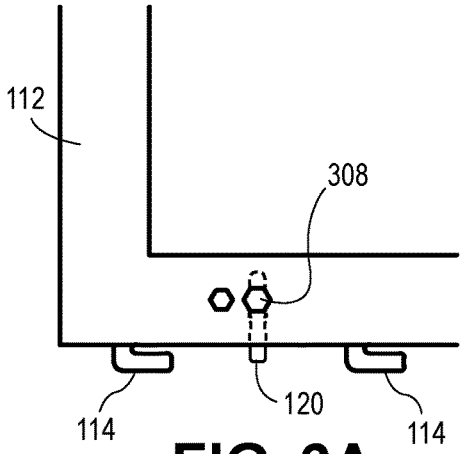
FIGS. 6A and 6B illustrate the relation between the frame attachment features and the first branch in one embodiment of the invention.
Figure 6B:
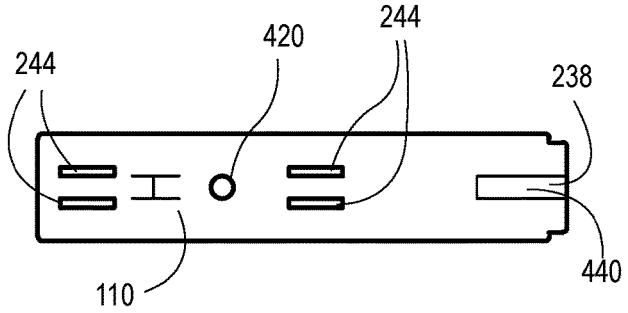

FIGS. 6A and 6B illustrate the relation between the frame attachment features and the first branch in one embodiment of the invention. Attachment features 114 drop into receivers 244. Once within the receiver 244, the assembly can slide slightly toward channel 238. This aligns locking pin 120 with locking bore 420. Once locking pin 120 engages locking bore 420 the attachment features 114 cannot disengage from the receiver until the locking pin 120 is disengaged.

In one embodiment the material that defines the first branch overlays the channel of the intermediate segment and defines a slot 440 that communicates with channel 238 and through which a shaft of the connector 700 (not shown in this figure) passes when the barrier is deployed. By overlaying the channel 238, the strength of the weld between the first branch 104 and the intermediate segment 108 can be increased. It is desirable to have a strong connection at this junction as much of the stress on the apparatus accrues at this junction as patrons, for example, inadvertently bump the barrier 102 in the deployed configuration.

Figure 7:
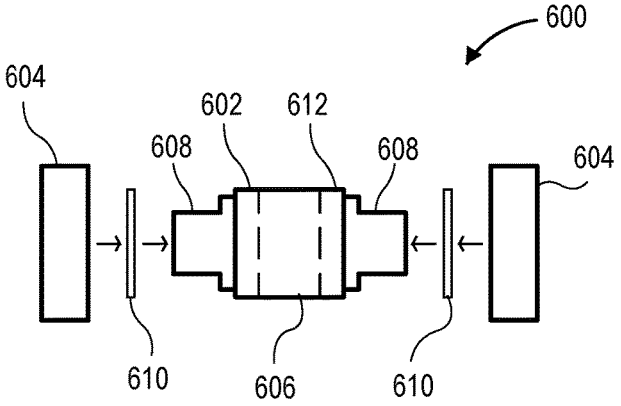
FIG. 7 is an exploded view of a bearing that forms part of the connector according to one embodiment of the invention.

FIG. 7 is an exploded view of a bearing that forms part of the connector according to one embodiment of the invention. The bearing 600 has an axle 602 with two hubs 608 and barrel 612 between the hubs 608. The barrel defines a bore 606 substantially perpendicular to a long axis of the axle 602. A washer 610 and roller bearing 604 are installed on each hub 608. Bearing 600 provides a linear translation degree of freedom to the connector. The long dimension of bearing 600 should be selected to allow the roller bearing to ride within on the track the channels (238, 236) in the intermediate segment 108 and second branch 106 without binding on the side of the channels. In one embodiment the channels 238, 236 are approximately 1.25 inches wide and the long dimension of bearing 600 is 1 inch. Other dimensions are in the scope and contemplation of embodiments of the invention. In some embodiments, the roller bearings 604 may be substituted for low friction glides instead or rolling elements. Suitable materials include ultra-high-molecular-weight polyethylene (UHMW) or other material that exhibit a low coefficient of friction with the material the forms the tracks along which the connector will move.

Figure 8A:
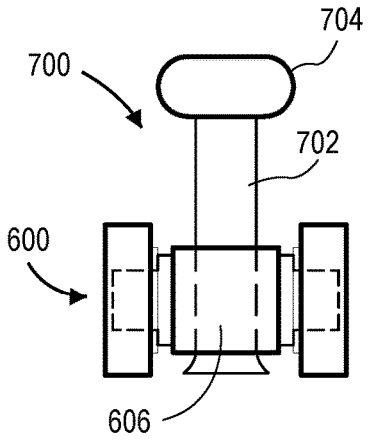
FIGS. 8A-8C are diagrams of a connector according to one embodiment of the invention.
Figure 8B:
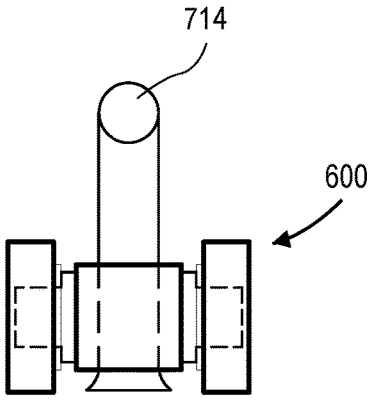
Figure 8C:
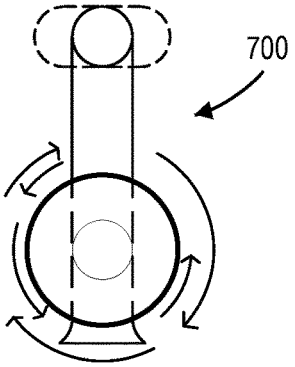

FIGS. 8A-8C are diagrams of a connector according to one embodiment of the invention. To complete the connector 700 a T-bolt is introduced into bore 606. T-bolt has a shaft 702 and a head 704. T-bolts have a generally T-shaped profile when view in at least one direction. In some embodiments, to retain the T-bolt in the bore 606, a distal end of the shaft 702 may be flared after insertion. In other embodiments, the distal end of the shaft may accept a small cotter pin or the like to retain the T-bolt in the bore. It is important that whatever retention mechanism is used not interfere with the roller bearings and not inhibit the rotation of the shaft 702 within the bore 606.

As more clearly shown in FIG. 8B, in some embodiments head 704 is substantially cylindrical. That is the ends 714 of the head 704 have a substantially circular cross section. The cylindrical ends 714 are capture with in bores or recesses in the frame. In such an embodiment the frame and barrier can pivot about the axis of the cylindrical head 704. As depicted in FIGS. 8A and 8B the shaft 702 can also rotate in the bore 606. In some embodiments, the shaft can is not constrained in its range of rotation. FIG. 8C reflect that the roller bearings unconstrained rotational motion in either direction. And as assembled provide the connector with a linear degree of freedom of motion. In this example, the connector 700 as a whole provides two rotational degrees of freedom and one linear degree of freedom to a connected frame and barrier assembly.

Figure 9A:
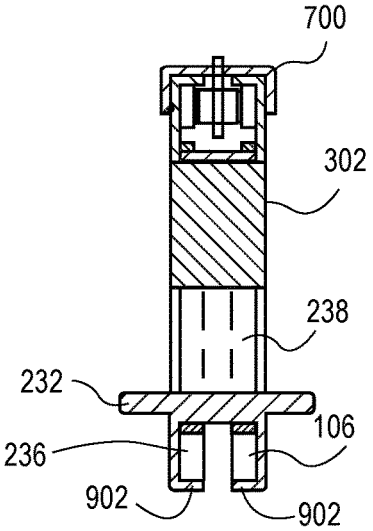
FIG. 9A is a sectional view of the embodiment of FIG. 3 taken through section A-A.

FIG. 9A is a sectional view of the embodiment of FIG. 3 taken through section A-A. In this view, connector 700 can be seen above channel 238 that is defined by intermediate segment 108. Lips 902 that form the bearing surface of the track in channel 236 are also visible. The roller bearings of connector 700 ride along the lips 902 as the barrier transitions into a stowed configuration.

Figure 9B:
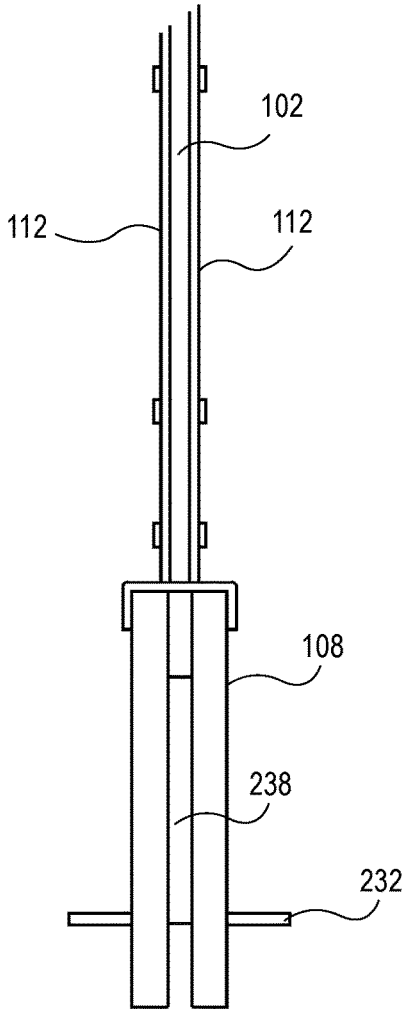
FIG. 9B is a front view of the embodiment of FIG. 3.

FIG. 9B is a front view of the embodiment of FIG. 3. In this view the channel 238 that allows the barrier to transition past the front of the bar between stowed and deployed configurations is visible.

Figure 10A:
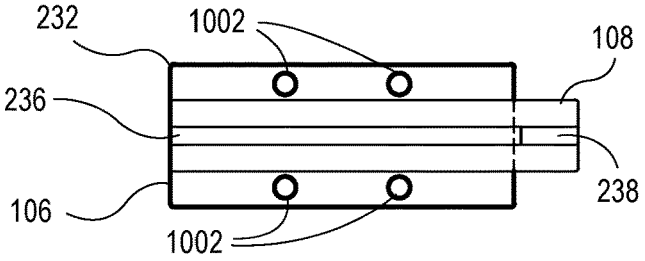
FIG. 10A is a plan view of the second branch connected to the intermediate segment in one embodiment of the invention.

FIG. 10A is a plan view of the second branch connected to the intermediate segment in one embodiment of the invention. The second branch 106 includes channel 236 and flange 232. The flange defines bores 1002 to enable coupling of the bracket to the surface. As previously discussed, the bores can be used in conjunction with a clamp plate, or could provide access to e.g., screw directly to the underside of the supporting surface or some intermediate substrate. In other embodiments, the flange 232 could be omitted and bores could be provided within the channel 236 to allow connection to the supporting surface. In embodiments that include the flange 232, the intermediate segment 108 need not (and generally will not) include a flange. The connection to the supporting surface is limited to the underside of the surface to limit potential damage to visible portions of the surface. As no connection between the intermediate segment 108 and the surface is required, intermediate surface 108 only needs to be wide enough to permit the connector to transition therethrough.

Figure 10B:
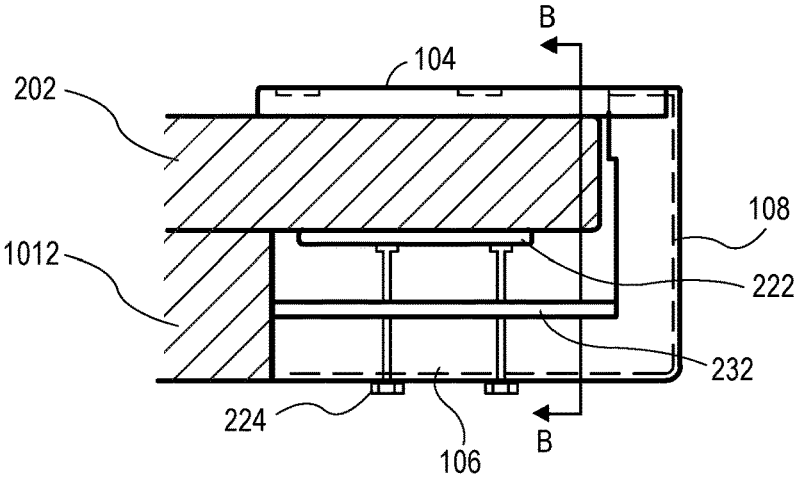
FIG. 10B is a side view of the bracket of one embodiment of the invention attached to a supporting surface.

FIG. 10B is a side view of the bracket of one embodiment of the invention attached to a supporting surface. In this example, supporting surface 302 is clamped between clamp plate 222 and first branch 104. Intermediate segment 108 lies forward of the front edge of supporting surface 302. Second branch 106 has been sized to abut vertical partition 1012 that hold the supporting surface 302. While the barrier assembly is not shown in this figure, by abutting vertical partition 1012, the connector would be trapped within the channel 236. Any of the different ways discussed above could be used to bias the connector to reside at the distal end of second branch 106. Furthermore, it is envisioned that other devices including without limitation, straps, snaps, hook and loop material or the like could engage the barrier assembly to hold it adjacent to the vertical partition.

Figure 11:
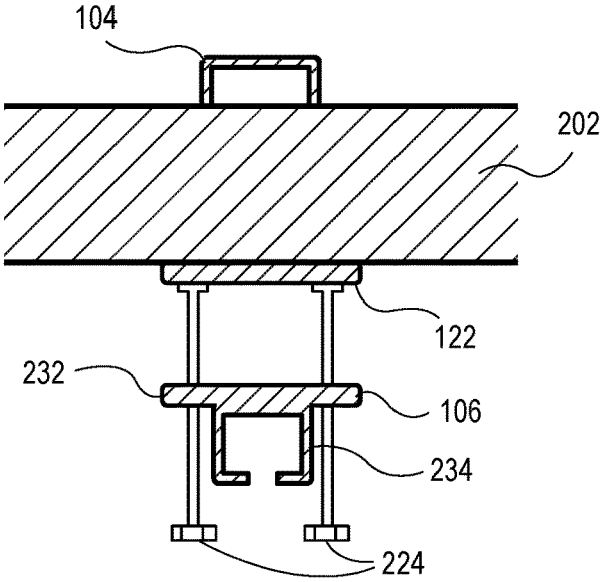
FIG. 11 is a sectional view of the bracket of FIG. 10B taken through section B-B.

FIG. 11 is a sectional view of the bracket of FIG. 10B taken through section B-B. In this embodiment, it can be seen that first branch 104 is relatively thin compared to the channel 236 of second branch 106. In this embodiment, the connector does not need to travel above the supporting surface. Accordingly, while the thickness of the channel 236 is dictated by the thickness required to allow the connector to travel and in particular turn the corner from the intermediate branch, the thickness of the first branch is the space required to allow attachment features to engage the first branch 104. Having a relatively thin first branch is desirable as it reduce the aesthetic impact of the bracket, especially when the barrier is in the stowed orientation.

Figure 12:
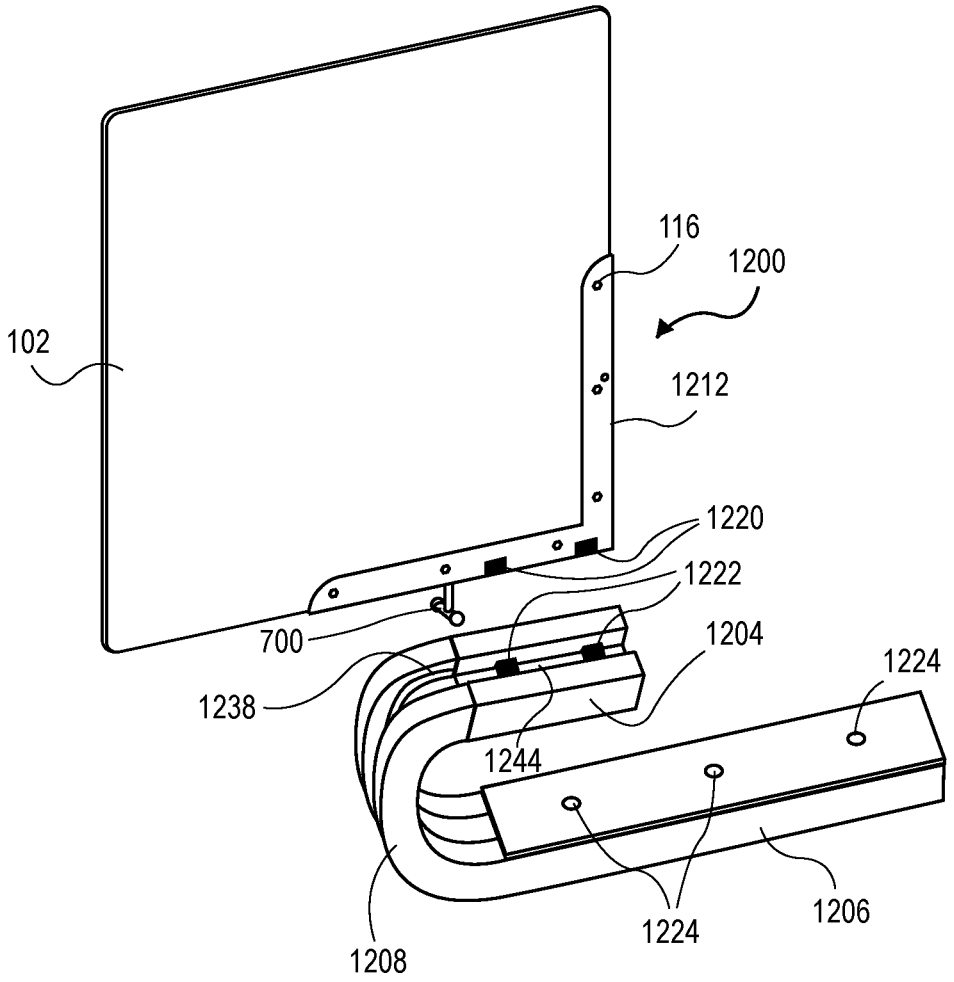
FIG. 12 is a perspective view of an alternative embodiment of the invention.

FIG. 12 is a perspective view of an alternative embodiment of the invention. In this embodiment, the bracket has a first branch 1204, and arcuate intermediate segment 1208 and a second branch 1206. Arcuate intermediate segment defines a channel 1238 in which connector 700 resides and can transition to a channel in the second branch 1206 to allow the barrier 102 to move to the stored position. In one embodiment, second branch 1206 defines a plurality of bores through which the bracket can be coupled to a supporting surface with the first branch 1204 above the surface and the second branch 1206 below the surface. In some embodiments, second branch 1206 and intermediate segment 1208 may be formed from a single piece of material. In one embodiment, second branch 1206 and intermediate segment 1208 are extruded from aluminum. In another embodiment, second branch 1206 and intermediate segment 1208 are bent from steel stock. In still another embodiment, second branch 1206 and intermediate segment 1208 are formed separately and coupled together, e.g., by welding.

First branch 1204 can be formed from any of the suitable materials discussed above. First branch 1204 defines a channel 1244 sized to allow barrier assembly 1200 to nest therein. In some embodiments the channel has a depth between one half and three quarters of the cross dimension of the frame 1212. The depth of the channel provides lateral support to reduce the risk of the barrier assembly 1200 becoming dislodged. One or more magnetic masses 1222 are provided in the channel 1244 to engage with one or more magnetic masses 1220 in the frame 1212. As used herein, "magnetic mass" includes permanent magnets and masses comprising magnetic material upon which a magnet may exert an attractive force. At least some of the magnetic masses should be permanent magnets and preferably rare earth magnets such as neodymium magnets.

Barrier 102 is coupled into a frame 1212. Frame 1212 could be formed in the same ways as described above with reference to frame 112, but instead of physical attachment features, one or more magnetic masses 1220 are coupled to or nested in the frame as the attachment features. As mentioned above, these magnetic masses 1220 attractively engage with magnetic masses 1220 to retain the barrier in the deployed configuration. To transition to the stowed configuration a user need only apply sufficient force to overcome the magnetic attraction and then the barrier assembly 1200 can be rotated about the connector 700 and moved along the channel 1238 and the channel (not shown) in the second branch 1206 to a location at the distal end of the second branch. Any of the various way of biasing discusses above could be used to bias the connector 700 to remain at the distal end of second branch 1206.

It should be understood that features of the embodiment could be hybridized with features of previously describe embodiments. By way of example without limitation, barrier assembly 1200 with first branch 1204 could be coupled to intermediate segment 108 and second branch 106. Similarly, intermediate segment 1208 could be used with first branch 104 and second branch 106 with the corresponding barrier assembly. Generally, any iteration of the described first branch second branch and intermediate segment could be use as long as the correct barrier assembly corresponding to the selected first branch is also used.

Figure 13:
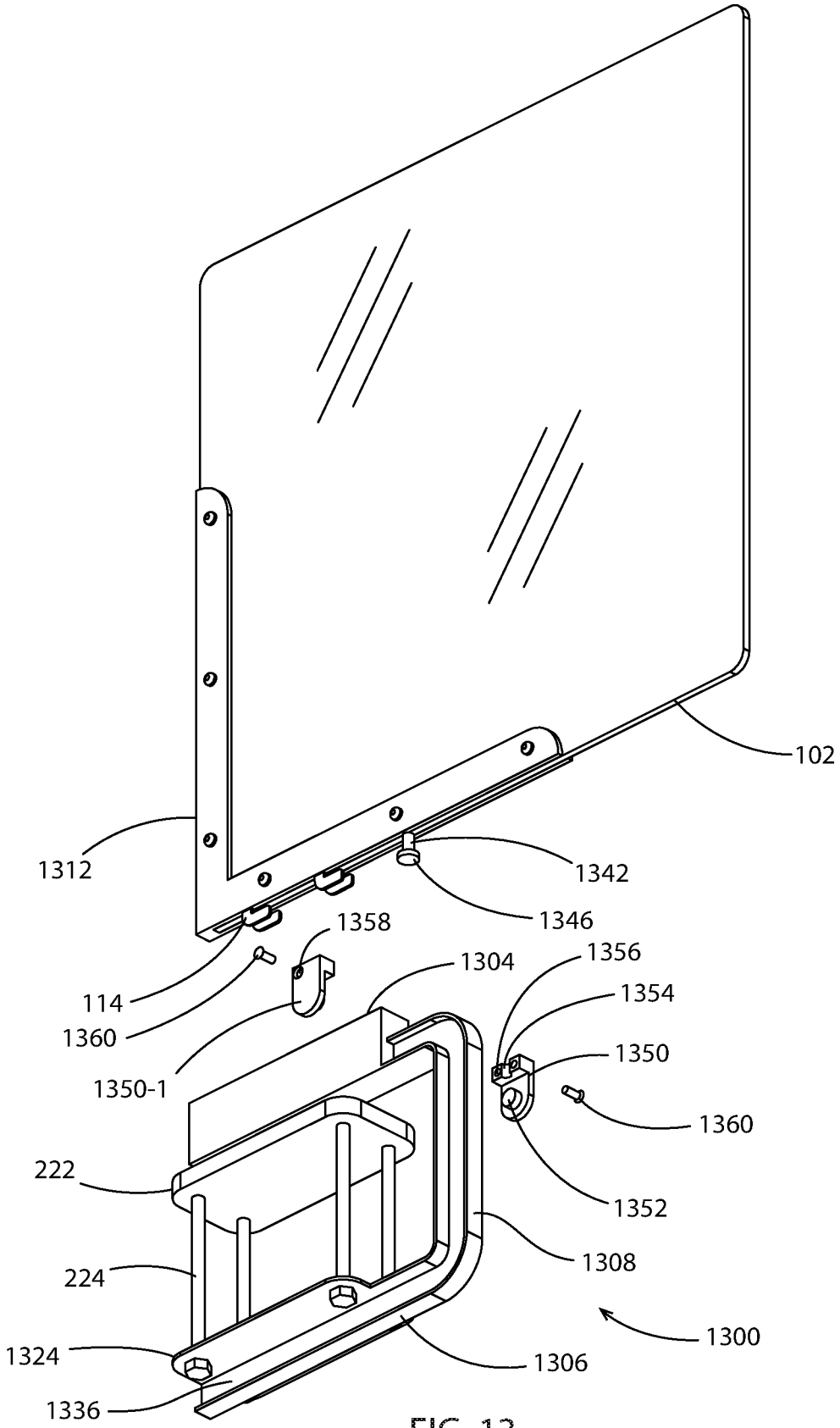
FIG. 13 is an exploded perspective view of an alternative embodiment of the invention.

FIG. 13 is an exploded perspective view of an alternative embodiment of the invention. Barrier 102 can be substantially identical to the barrier 102 described with the various embodiments above. Similarly, frame 1312 can be formed in the same ways as described with reference frame 112 above. In some embodiments, frame 1312 has physical attachment features 114 that engage physical receiving slots in the first branch 1306 when the barrier is in a deployed configuration. In other embodiments, physical attachment features could be replaced by magnetic masses that interact with magnetic masses in the first branch 1306 to retain the barrier 102 in a deployed configuration. Some embodiments may include a locking pin (not shown) to further secure the barrier 102 in the deployed configuration.

Frame 1312 exposes a stem 1342 and head 1346 that can be used to couple the barrier assembly the bracket 1300. In some embodiments, stem 1342 and head 1346 are integrally formed with the frame. That is, in various embodiments, the stem and head could be e.g., cast, extruded or molded as part of the frame. In other embodiment stem 1342 and head 1346 may be part of a separate structure (like T-bolt of FIG. 8) trapped within the frame.

Bracket 1300 has a first branch 1304 and a second branch 1306 that, in use, reside above and below a supporting surface respectively. An intermediate segment 1308 couples the first branch 1304 and second branch 1306 together. In various embodiments, the bracket 1300 could be unitarily formed by extrusion, casting or molding or the like. In other embodiments, some portions of the bracket may be formed separately and coupled together. In use, the intermediate segment resides forward of the front edge of the supporting surface. Intermediate segment 1308 and second branch 1306 collectively define a track that constrains the path that the barrier 102 can move between a deployed configuration and a stowed configuration. As detail further below, the intermediate segment 1308 and the second branch 1304 have a generally I shaped cross section. The crosses of the I define the track 1336 along a clamp 1350 coupled to the barrier assembly can move.

Clamp 1350 in conjunction with stem 1342 and head 1346 provide a connector between the track 1336 and the barrier that allows the barrier 102 to move in plural degrees of freedom relative to the track 1336. In one embodiment, clamp is formed in two identical halves 1350-1, 1350-2 (collectively 1350). Each half 1350-1, 1350-2 defines a stem slot 1354 with a radius greater than the radius of stem 1342. In one embodiment, each half 1350-1, 1350-2 also defines a counter sunk threaded bore to accept a connecting screw 1360, and a corresponding threaded receiving bore 1356 to be engage by the screw 1360 to couple the two halves 1350-1, 1350-2 together. For clarity, the counter sunk bore 1358 of half 1350-1 aligns with the receiving bore 1356 of half 1350-2 and vice versa.

Each half 1350-1, 1350-2 also includes a mounting post 1352. When assembled, the mounting posts 1352 reside in the track 1336 and the stem 1342 resides in the stem slots 1356. When assembled, the stem slots 1356, collectively have a diameter greater than the diameter of the stem 1342 and head reside in a space internal to the clamp 1350. This allow the barrier to rotate relative to the clamp 1350. In some embodiment, clamp halves 1350-1, 1350-2 are cast or molded from UHMW or another material with a low coefficient of friction relative to the material from which the track 1336 is formed.

The bracket 1300 could use any of the previously describe way to couple to the supporting surface. In one embodiment, second branch 1306 has a flange 1324 that defines bores to receive bolts 224 that move clamp plate 222 to clamp the supporting surface between clamp plate 222 and first branch 1304. As with other embodiments, protective spacers may be used between the first branch 1304 and the supporting surface. In other embodiments, the second branch may be coupled to the underside of the supporting surface (directly or through a shim or other substrate) using screws, adhesives or the like.

As with previously described embodiments, in the stowed configuration, the barrier 102 is turned to be substantially perpendicular to the track 336 and it is desirable that it remain near the distal end of branch 1306. Any for the previously described stays can be used to bias the barrier to remain near the distal end. For example, and not limitation, the second branch could be installed with a slight downward slant such that gravity will bias the assembly toward the distal end. Detents, depressions or magnets could also be used. The end of the second branch 1306 could terminate in a lip, wall, or cap to prevent the assembly from leaving the end of the track. In other embodiments, the second branch 1306 could be sized to abut the vertical structure of the supporting surface to ensure retention of the assembly.

Figure 14:
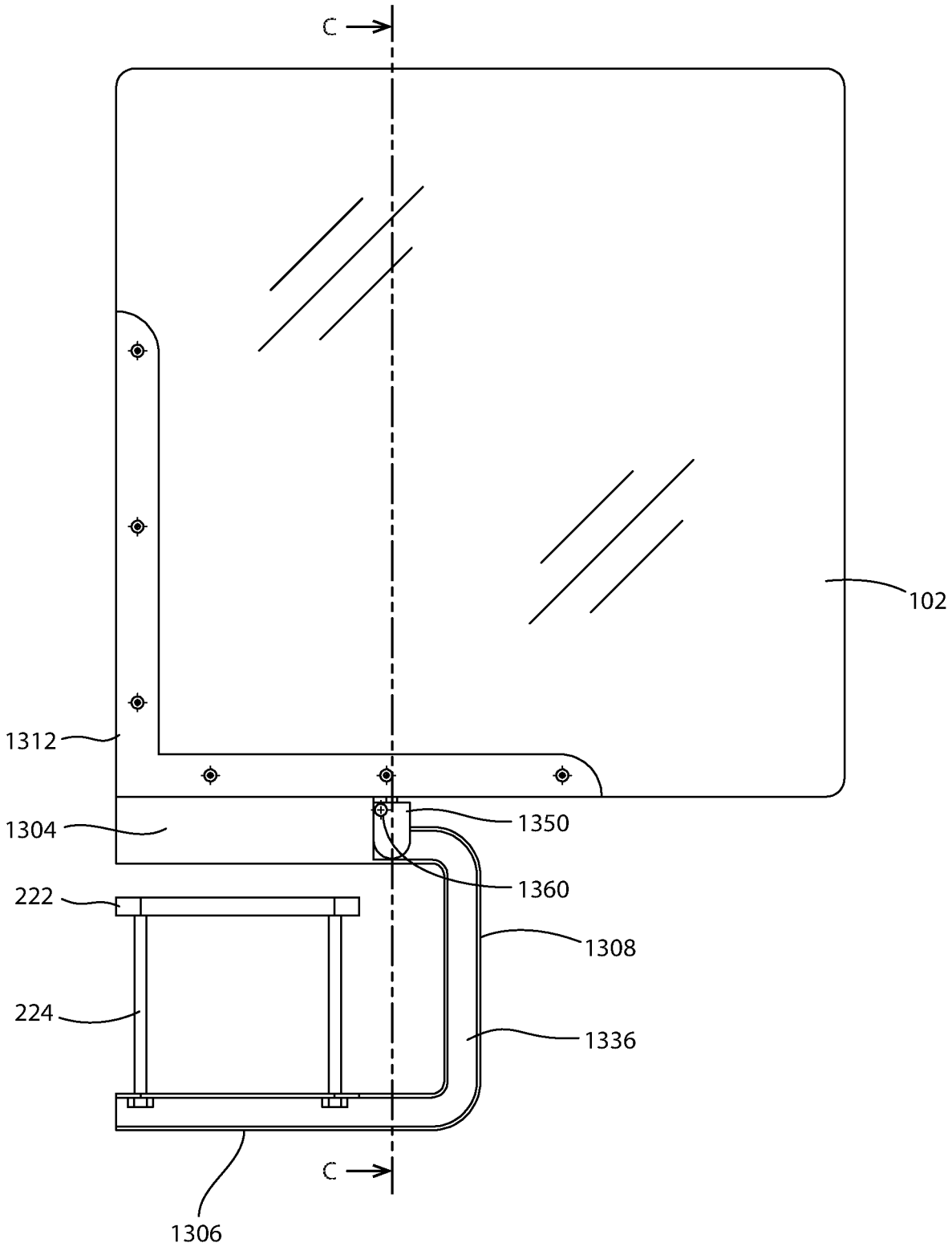
FIG. 14 is a side view of the embodiment of FIG. 13 with the barrier in the deployed configuration.

FIG. 14 is a side view of the embodiment of FIG. 13 with the barrier in the deployed configuration. Barrier 102 in frame 1312 is attached to first branch 1304 to remain fixed substantially parallel to the track 1336 (substantially perpendicular to a leading edge of the supporting surface not shown). The barrier assembly is coupled to the clamp 1350 the posts (not shown in this view) of which ride in the track 1336.

To transition to the stowed configuration, the frame 1312 is detached from the first branch 1304. The barrier 102 can then swivel relative to the clamp 1350 to adopt an orientation perpendicular to the track 1336 and the clamp with barrier can transition along the track 1336 in the intermediate segment 1308 into the track in the second branch 1306 coming to rest at the distal end thereof.

Figure 15A:
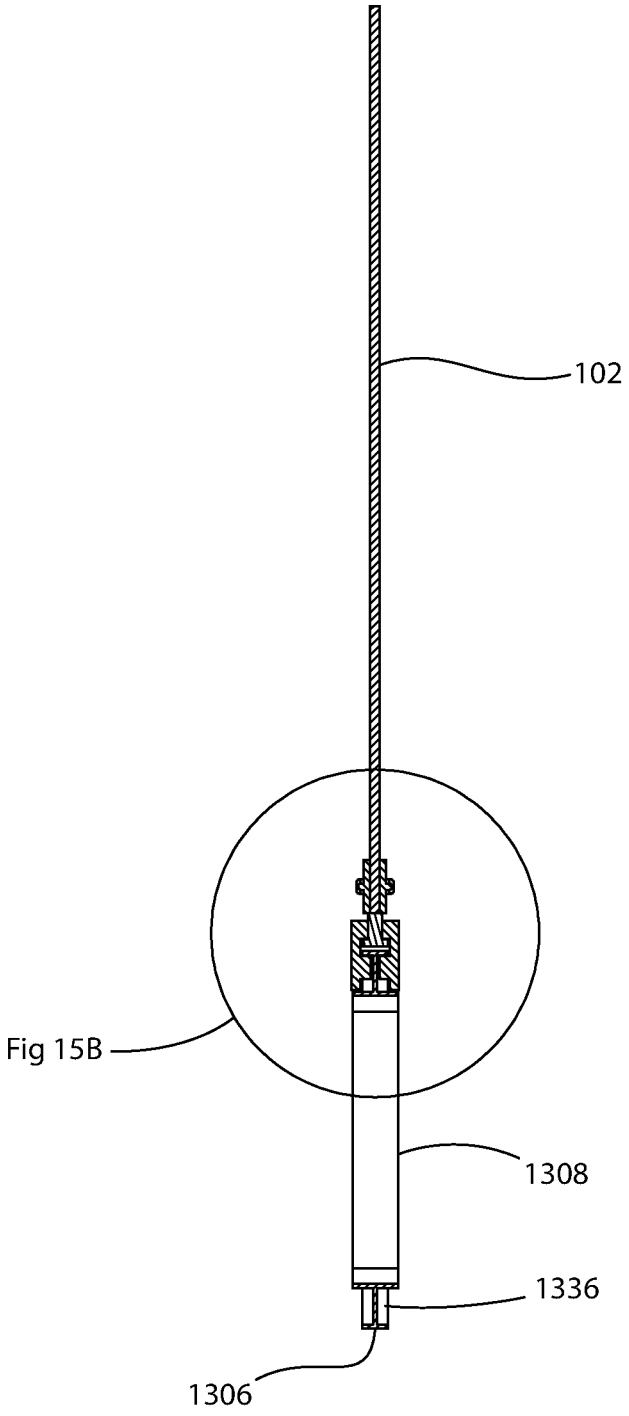
FIGS. 15A and 15B are sectional views taken through section C-C.
Figure 15B:
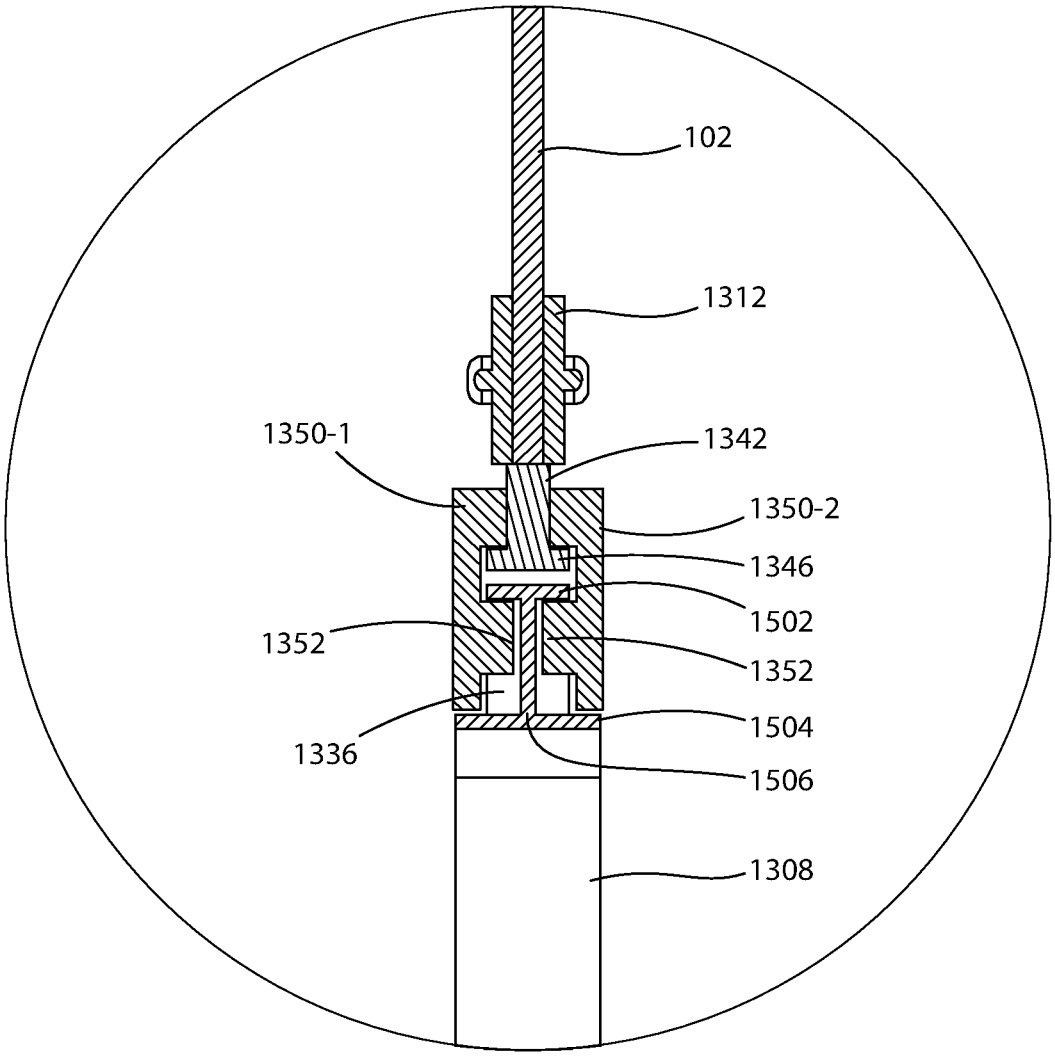

FIGS. 15A and 15B are sectional views taken through section C-C. FIG. 15A shows the section of the barrier 102 and the I shaped cross section of the second branch 1306. In some embodiments, 1308 will have the same I cross section. The track 1336 is defined by the crosses and stem of the I.

FIG. 15B shows a detailed sectional view of the interaction between the assembly and the track. Barrier 102 and frame 1312 are formed with or coupled to stem 1342. Clamp halves 1350-1 and 1350-2 each define a stem slot that collectively provide rotatable coupling between the stem 1342 and the clamp 1350. Head 1346 resides in an internal space of the clamp 1350. Th mounting posts 1352 are captured within the track 1336. I crosses 1502 and 1504 define the edges of track and I stem 1506 connects these edges. Generally during the transition between the deployed configuration and the stowed configuration, the mounting posts 1352 will ride along I cross 1502. I cross 1502 (in the second branch 1306) provides the weight bearing surface in the stowed configuration.

While in this embodiment, clamp 1350 has no moving parts, in other embodiments, mounting posts 1352 could be replaced with other rolling or gliding elements such as roller bearings, bearing races, flat glides or the like. Applicant has not exhaustively enumerated all the possible iterations of features from one embodiment that may be employed in another embodiment. Applicant submits that those skilled in the art will recognize that features of some embodiment can readily be substituted into other embodiments and that all of these various combinations are intended to fall within the scope of the embodiment of Applicant's invention.

In the foregoing specification, the invention has been described with reference to specific embodiments thereof. It will, however, be evident that various modifications and changes can be made thereto without departing from the broader spirit and scope of the invention as set forth in the appended claims. The specification and drawings are, accordingly, to be regarded in an illustrative rather than a restrictive sense.

What is claimed is:

1. An apparatus comprising:

a barrier;

a bracket configured to be coupled to a support surface such that a first branch of the bracket resides on a first side of the support surface and a second branch of the bracket resides on a second side of the support surface, the bracket defining a track that extends along at least a portion of the second branch; and a connector coupling the barrier to the track, the connector enabling the barrier to move in at least two degrees of freedom relative to the track;

wherein the barrier and connector are movable along the track from a first position in which the barrier resides along the first branch above the support surface to a second position along the second branch in which the barrier and connector resides below the support surface.

2. The apparatus of claim 1, wherein the connector retains the barrier substantially parallel with the track in the first position and substantially perpendicular to the track in the second position.

3. The apparatus of claim 1, wherein the barrier comprises:

a frame to hold a barrier member; and an attachment feature to couple the barrier to the first branch of the bracket.

4. The apparatus of claim 1 further comprising:

a lock to maintain a relative position of the barrier and the bracket when the barrier is in the first position.

5. The apparatus of claim 1, wherein the connector comprises:

an axle;

first and second rotational bearings coupled to opposing ends of the axle; and a T-bolt rotatably coupled to the axle between the first and second bearing.

6. The Apparatus of claim 5, wherein each of the first and second rotational bearings can rotate 360° about the axle and the T-bolt can rotate 360° normal to the axle.

7. The apparatus of claim 1 further comprising:

at least one spacer coupled to the bracket and configured to reside between the first branch and the support surface.

8. The apparatus of claim 1 wherein, the second branch is longer than the first branch.

9. The apparatus of claim 1 further comprising:

a stay at a distal end of the second branch to bias the connector to remain proximate to the distal end.

10. The apparatus of claim 1, wherein the connector comprises:

a pair of mounting posts; and a rotatable shaft coupling.

11. The apparatus of claim 1 wherein the barrier is vertically oriented in the first position and configured to physically separate adjacent persons along the support surface.

12. An apparatus comprising:

a barrier member;

a bracket configured to be coupled to a support surface such that a first branch of the bracket resides on a first side of the support surface and a second branch of the bracket resides on a second side of the support surface, the bracket defining a track; and means for coupling the barrier member to the bracket, the means for coupling the barrier member to the bracket enabling the barrier to move in at least two degrees of freedom relative to the bracket and transition between a first position on the first branch of the bracket and a second position on the second branch of the bracket.

13. The apparatus of claim 12, wherein the means for coupling comprises:

means for translating the barrier along the track; and means for rotating the barrier relative to the bracket.

14. The apparatus of claim 12 further comprising:

means for engaging the bracket to ensure the barrier remains stationary in the first position.

15. The apparatus of claim 12 further comprising:

means for spacing coupled to the first branch and configured to prevent contact between the first branch and the first side of the support surface.

16. The apparatus of claim 12 further comprising:

means for retaining the barrier in the second position, wherein the barrier is substantially perpendicular to the track in the second position.

* * * * *